US009845804B2

(12) United States Patent
Ouwenga et al.

(10) Patent No.: US 9,845,804 B2
(45) Date of Patent: Dec. 19, 2017

(54) POSITIVE DISPLACEMENT PUMP ASSEMBLY WITH MOVABLE END PLATE FOR ROTOR FACE CLEARANCE CONTROL

(71) Applicant: EATON CORPORATION, Cleveland, OH (US)

(72) Inventors: Daniel R. Ouwenga, Cleveland, OH (US); Brian T. Smith, Cleveland, OH (US)

(73) Assignee: Eaton Corporation, Cleveland, OH (US)

( * ) Notice: Subject to any disclaimer, the term of this patent is extended or adjusted under 35 U.S.C. 154(b) by 24 days.

(21) Appl. No.: 14/398,039

(22) PCT Filed: Apr. 29, 2013

(86) PCT No.: PCT/US2013/038589
§ 371 (c)(1),
(2) Date: Oct. 30, 2014

(87) PCT Pub. No.: WO2013/165876
PCT Pub. Date: Nov. 7, 2013

(65) Prior Publication Data

US 2015/0118094 A1 Apr. 30, 2015

Related U.S. Application Data

(60) Provisional application No. 61/640,330, filed on Apr. 30, 2012.

(51) Int. Cl.
*F01C 19/08* (2006.01)
*F01C 19/10* (2006.01)
(Continued)

(52) U.S. Cl.
CPC ..... *F04C 27/006* (2013.01); *F01C 21/108* (2013.01); *F04C 18/16* (2013.01);
(Continued)

(58) Field of Classification Search
CPC ..... F04C 14/10; F04C 28/18; F04C 29/12; F04C 21/108; F04C 27/006; F04C 2240/52; F04C 2270/17
(Continued)

(56) References Cited

U.S. PATENT DOCUMENTS 2,312,886 A * 3/1943 Ellinwood ..... F04C 2/3442 418/212
2,853,023 A * 9/1958 English ..... F04C 2/3442 418/133
(Continued)

FOREIGN PATENT DOCUMENTS

WO WO 2005/047706 A1 5/2005
WO WO 2006/061558 A1 6/2006

OTHER PUBLICATIONS

International Search Report for corresponding International Patent Application No. PCT/US2013/038589 dated Mar. 4, 2014.

*Primary Examiner* — Mark Laurenzi
*Assistant Examiner* — Deming Wan
(74) *Attorney, Agent, or Firm* — Merchant & Gould P.C.

(57) ABSTRACT

A positive displacement pump assembly includes a rotor housing defining a rotor cavity, and an end plate configured to at least partially close one end of the rotor cavity. Rotors are supported on and fixed to rotor shafts and extend through the rotor cavity. A first pair of bearings fixing the rotor shafts to the end plate. A second pair of bearings fixes the rotor shafts to the rotor housing, preventing relative axial movement between the rotor shafts and the rotor housing. The end plate is axially movable with the rotor shafts when the rotor shafts vary in axial length due to thermal fluctuations so that changes in an axial clearance at end faces of the rotors are reduced.

26 Claims, 5 Drawing Sheets

(51) Int. Cl.

| | |
|---|---|
| ***F04C 15/06*** | (2006.01) |
| ***F04C 27/00*** | (2006.01) |
| ***F04C 18/16*** | (2006.01) |
| ***F01C 21/10*** | (2006.01) |
| ***F04C 29/00*** | (2006.01) |

(52) U.S. Cl.
CPC ..... *F04C 29/005* (2013.01); *F04C 2240/52* (2013.01); *F04C 2270/17* (2013.01)

(58) Field of Classification Search
USPC ..... 418/133, 105–108, 132, 134, 206.1, 418/206.4, 206.7, 206.6, 73, 130, 135, 418/131
See application file for complete search history.

(56) References Cited

U.S. PATENT DOCUMENTS 3,068,804 A * 12/1962 Thrap ..... F04C 15/0026 415/111
3,083,645 A 4/1963 Donner et al.
3,137,238 A * 6/1964 Gordon ..... F04C 15/0026 418/132
3,203,355 A * 8/1965 Purcell ..... F04C 15/0026 418/132
3,204,565 A * 9/1965 Kirkpatrick ..... F01C 1/344 418/133
3,582,241 A * 6/1971 Niemiec ..... F04C 15/0023 418/107
3,778,200 A * 12/1973 Wellman ..... F04C 15/0026 418/132
4,073,605 A * 2/1978 Wakeman ..... F04C 2/126 417/283
4,281,974 A * 8/1981 Teruyama ..... F04C 15/0026 418/132
4,449,898 A * 5/1984 Lambeck ..... F04C 2/105 137/625.2
5,683,229 A * 11/1997 Stoll ..... F01C 21/02 417/366
8,491,194 B2 * 7/2013 Hagan ..... F16C 33/201 384/278
8,813,492 B2 * 8/2014 Hansen ..... F01C 11/008 123/559.1

* cited by examiner

POSITIVE DISPLACEMENT PUMP ASSEMBLY WITH MOVABLE END PLATE FOR ROTOR FACE CLEARANCE CONTROL

This application is is a National Stage Application of PCT/US2013/038589, filed 29 Apr. 2013, which claims benefit of U.S. Patent Application Ser. No. 61/640,330 filed on 30 Apr. 2012 and which applications are incorporated herein by reference. To the extent appropriate, a claim of priority is made to the above disclosed applications.

TECHNICAL FIELD

The present teachings generally include a positive displacement pump assembly, such as a supercharger assembly for an engine.

BACKGROUND

Positive displacement pumps can be used to add fluid pressure under certain operating conditions. A supercharger is one type of positive displacement pump that is used to boost air pressure at an engine air intake. Positive displacement air pumps typically have meshing, multi-lobed rotors within a rotor housing. Air is moved from an inlet to an outlet; clearance between the rotors and the rotor housing is designed to prevent air from following unintended paths. Air leakage around the rotor end faces is one unintended path and a cause of positive displacement air pump inefficiency.

The rotors are mounted on rotor shafts. The rotors and rotor shafts may tend to expand and contract due to thermal fluctuations. The rotor housing may also tend to expand and contract, and may do so at different rates than the rotors or rotor shafts, especially if formed from a different material. One solution has been to leave a gap between the rotor face and the rotor housing at the inlet end of the housing that is sufficiently large to allow the rotor shafts and the housing to expand relative to one another. The rotor shafts are typically fixed axially to the rotor housing at one end by bearings, referred to herein as axial bearings. Needle bearings between the rotor shafts and the rotor housing on the other end allow the rotor shafts to expand and contract axially relative to the rotor housing.

SUMMARY

A positive displacement pump assembly is provided that allows axial expansion and contraction of rotors and rotor shafts relative to the housing along the length of the rotor cavity while reducing a change in axial clearance at faces of the rotors. The positive displacement pump assembly includes a rotor housing defining a rotor cavity, and an end plate configured to at least partially close one end of the rotor cavity. Rotors are fixed to and supported on rotor shafts and extend through the rotor cavity. A first pair of bearings fixes the rotor shafts axially to the end plate. A second pair of bearings fixes the rotor shafts axially to the rotor housing, preventing relative axial movement between the rotor shafts and the rotor housing. The end plate is axially movable with the rotor shafts when the rotor shafts vary in axial length due to thermal fluctuations so that changes in the axial clearance at the end faces of the rotors due to thermal fluctuations is substantially reduced. The effect of material selection and associated thermal expansion rates of the rotors, rotor shafts, and the rotor housing on the clearance is thus significantly reduced, and leakage through the clearance will thus be minimized with a corresponding increase in efficiency of the positive displacement pump assembly.

The above features and advantages and other features and advantages of the present teachings are readily apparent from the following detailed description of the best modes for carrying out the present teachings when taken in connection with the accompanying drawings.

DETAILED DESCRIPTION

Figure 1:
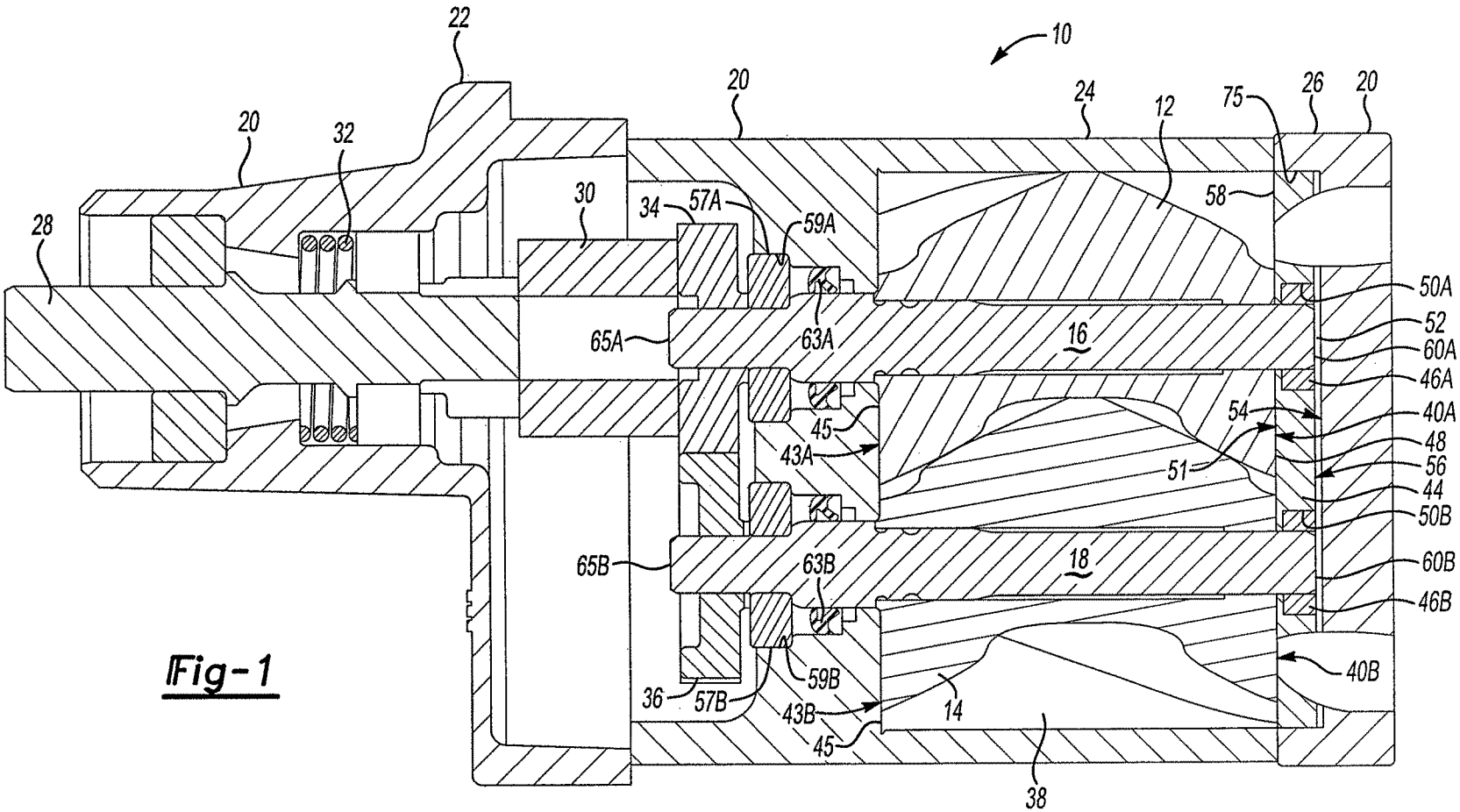
FIG. 1 is a schematic cross-sectional illustration of a positive displacement pump assembly taken at lines 1-1 in FIG. 5 in accordance with one aspect of the present teachings.

Referring to the drawings, wherein like reference numbers refer to like components throughout the several views, FIG. 1 shows a positive displacement pump assembly 10. In this embodiment, the positive displacement pump assembly 10 is a supercharger assembly for an engine, although the positive displacement pump assembly 10 may be used to pump other fluids and in other applications. The positive displacement pump assembly 10 has a first rotor 12 that meshes with a second rotor 14. Each of the rotors 12, 14 has multiple lobes. The first rotor 12 is mounted on and rotates with a first rotor shaft 16. The second rotor 14 is mounted on and rotates with a second rotor shaft 18 that is generally parallel with the first rotor shaft 16.

The rotors 12, 14 and rotor shafts 16, 18 are contained within a multi-component positive displacement pump housing 20. The housing 20 includes a front cover 22, a midportion 24 that can be referred to as a rotor housing portion, and an end portion 26. The front cover 22 and the end portion 26 are fastened with bolts or otherwise secured to the midportion 24.

An input shaft 28 that can be driven by an engine belt or other drive input is operatively connected to the first rotor shaft 16 through a coupling 30. A torsion spring 32 is connected at one end to the front cover 22 of the positive displacement pump housing 20 and at another end to the input shaft 28. The torsion spring 32 damps vibrations of the input shaft 28. A first timing gear 34 is mounted on and rotates with the first rotor shaft 16 and meshes with a second timing gear 36 mounted on and rotating with the second rotor shaft 18 to cause rotation of the second rotor shaft 18.

Figure 5:
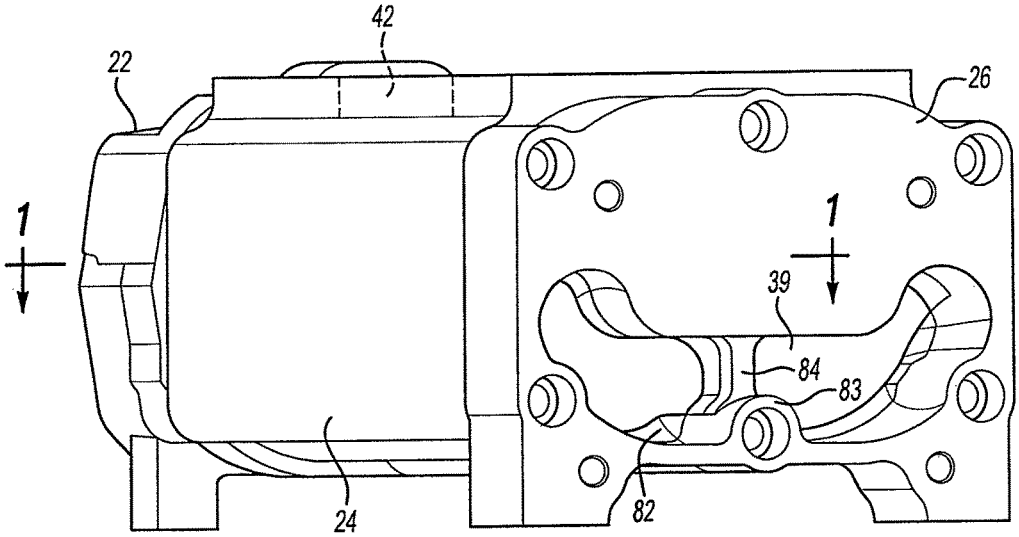
FIG. 5 is a schematic perspective illustration of the positive displacement pump assembly of FIG. 5, with the end portion attached to a midportion of the rotor housing.

The midportion 24 defines a rotor cavity 38 through which the rotor shafts 16, 18 extend and in which the rotors 12, 14 rotate. A fluid such as air is driven through the rotor cavity 38 from an inlet 39 (shown in FIG. 5 and referred to herein as an air inlet) in the end portion 26 to an outlet 42 in the midportion 24 (shown in hidden lines in FIG. 5 and referred to herein as an air outlet). Air that can be passed from the air inlet 40 to the air outlet 42 by passing between the mesh of the rotors 12, 14, or air that exits out of the rotor cavity 38 by passing back to the inlet 39 along first axial end faces 40A, 40B of the rotors 12, 14 or along second axial end faces 43A, 43B of the rotors 12, 14 is referred to as "leakage" and decreases the efficiency of the positive displacement pump assembly 10. In order to minimize such leakage, changes in an axial clearance 45 between the midportion 24 and the second end faces 43A, 43B due to thermal fluctuations, as well as changes in an axial clearance 48 at the first end faces 40A, 40B due to thermal fluctuations are minimized while the positive displacement pump assembly 10 still accommodates axial expansion and contraction of the rotors 12, 14 and rotor shafts 16, 18 relative to the rotor housing 20 due to the thermal fluctuations.

Specifically, an end plate 44 is axially fixed for movement with the rotor shafts 16, 18 by a first pair of bearings 46A, 46B positioned between the rotor shafts 16, 18 and the end plate 44. The bearings 46A, 46B are press fit into stepped openings 50A, 50B in the end plate 44. The stepped openings 50A, 50B are best shown in FIGS. 1 and 3. The bearings 46A, 46B are configured to permit the rotor shafts 16, 18 to rotate relative to the end plate 44, but fix the axial position of the rotor shafts 16, 18 relative to the end plate 44. Changes in a first predetermined clearance 48 between the first end faces 40A, 40B and a face 51 of the end plate 44 (best shown in FIG. 2) due to thermal fluctuations are thus minimized. The clearance 48 is very small relative to the surrounding components, and is indicated in FIG. 1 as a line at the end faces 40A, 40B. A second axial clearance 52 between an internal surface 54 of the end portion 26 and a face 56 of the end plate 44 can vary in size as the end plate 44 moves toward or away from the surface 54 because the end plate 44 is not axially fixed to the rotor housing 20. The surface 51 of the end plate 44 defines an end 58 of the rotor cavity 38.

A second pair of bearings 57A, 57B is positioned between the midportion 24 and the rotor shafts 16, 18 and axially fixes the rotor shafts 16, 18 to the midportion 24. The bearings 57A, 57B are referred to herein as axial bearings. The bearings 57A, 57B are press fit into stepped openings 59A, 59B of the midportion 24 near second axial ends 65A, 65B of the rotor shafts 16, 18. The bearings 57A, 57B are configured to permit the rotor shafts 16, 18 to rotate relative to the midportion 24, but fix the axial position of the rotor shafts 16, 18 relative to the midportion 24. Seals 63A, 63B are positioned around the rotor shafts 16, 18 in the stepped openings 59A, 59B between the axial bearings 57A, 57B and the rotor cavity 38. Oil can fill the stepped openings 59A, 59B around the seals 63A, 63B, and the seals 63A, 63B prevent oil leakage into the rotor cavity 38.

As the temperature of the positive displacement pump assembly 10 increases, the rotors 12, 14 and rotor shafts 16, 18 and the rotor housing 20 may expand axially an amount dependent on the linear thermal expansion coefficient of the materials from which they are formed. Expansion of the rotors 12, 14, rotor shafts 16, 18 and rotor housing 20 is also dependent on a temperature gradient that may exist along the length of the rotors 12, 14 and the housing 20 due to the fact that compressed air (or other fluid) at the outlet 42 of the housing 20 is much hotter than the air (or other fluid) at the inlet 39 of the housing 20. This may cause the ends 60A, 60B of the shafts 16, 18 to move axially toward or away from the surface 54 of the end portion 26, varying the clearance 52. The width of the clearance 52 does not affect leakage of the positive displacement pump assembly 10. By reducing variations of the clearance 48, and instead allowing the width of the clearance 52 to vary freely with the thermal fluctuations, the end plate 44 can provide a high efficiency for the positive displacement pump assembly 10.

In one nonlimiting example, the rotor shafts 16, 18 can be a first material, such as steel, and the rotor housing 20 can be a second material, such as an aluminum alloy. These materials have different rates of linear thermal expansion and contraction, quantified as coefficient of linear thermal expansion. For example, the coefficient of linear thermal expansion of steel may be $13\times10^{-6}$ meters per meter per degree Kelvin, while that of Aluminum may be $22.2\times10^{-6}$ meters per meter per degree Kelvin, and that of an Aluminum alloy somewhere therebetween. However, the end plate 44 is fixed to move axially with the rotor shafts 16, 18 and so will significantly reduce variations in the clearance 48 despite these different rates of expansion and contraction. The end plate 44 can be the same material as the rotors 12, 14 to best maintain the clearance 48.

Figure 2:
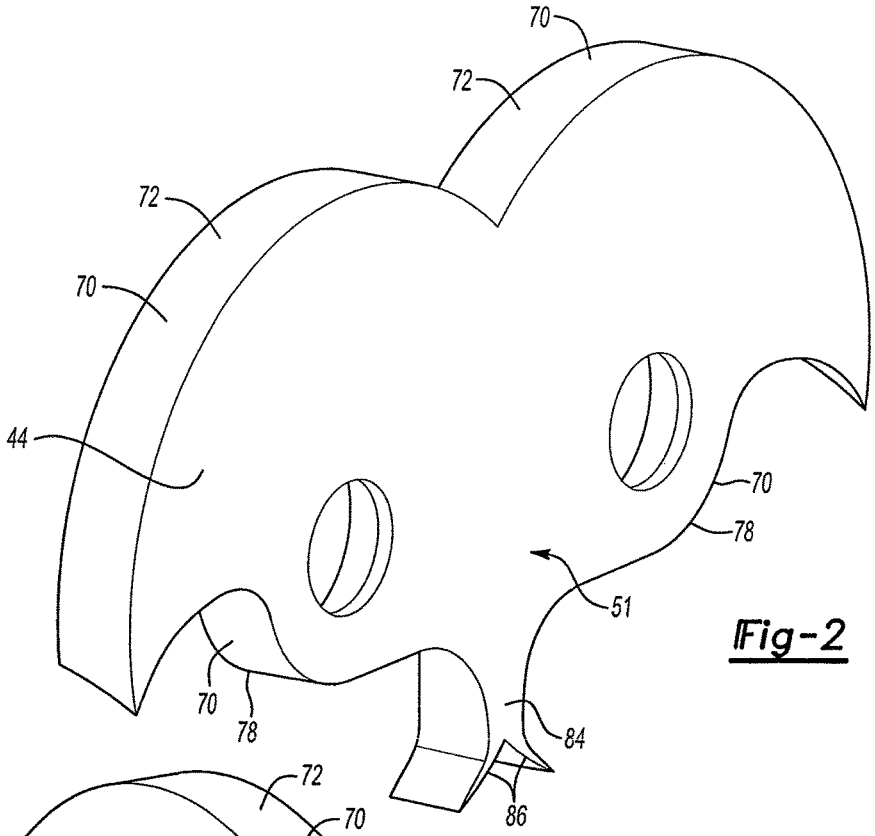
FIG. 2 is a schematic perspective illustration of an axial end plate of the positive displacement pump assembly of FIG. 1.
Figure 3:
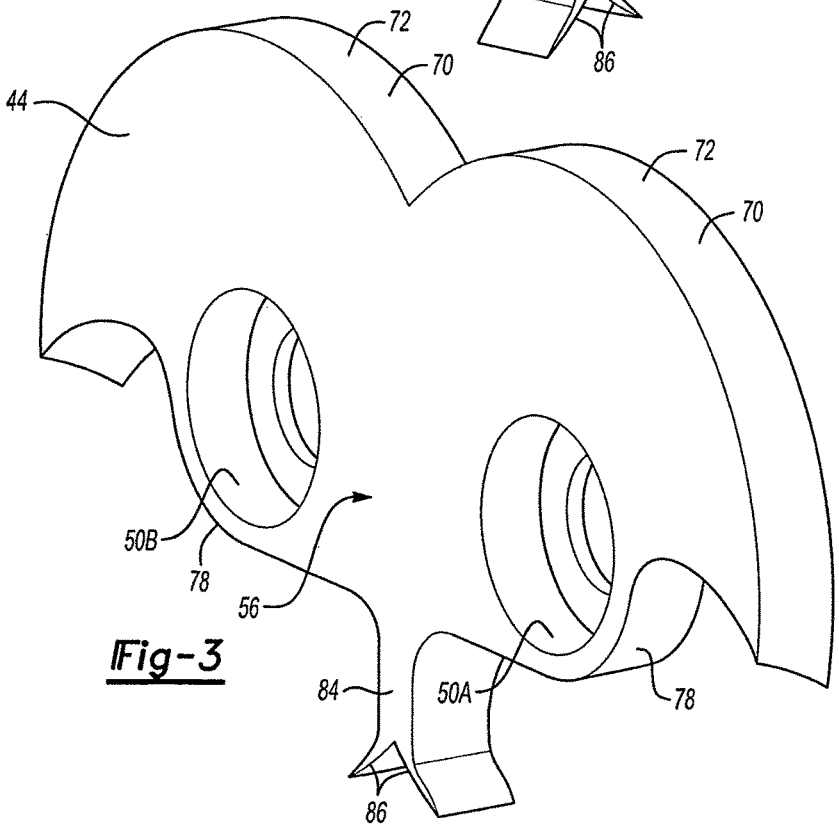
FIG. 3 is another schematic perspective illustration of the axial end plate of FIG. 2.
Figure 7:
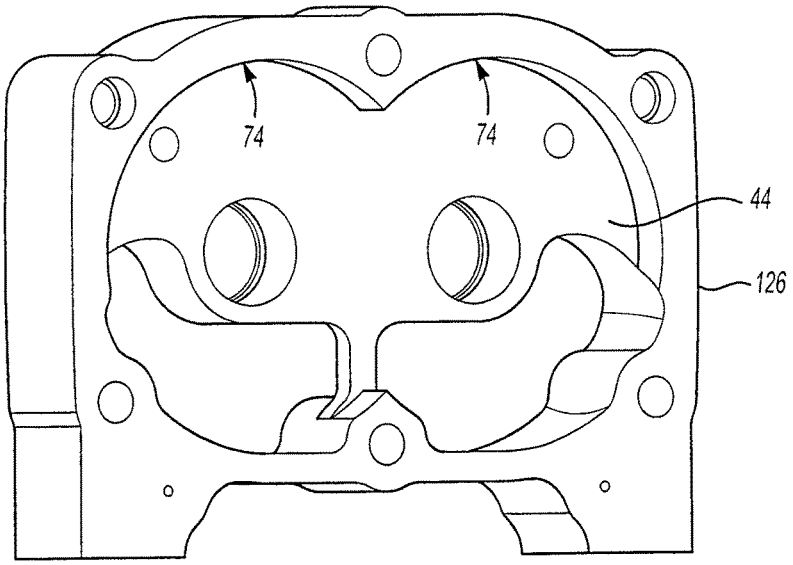
FIG. 7 is a schematic perspective illustration of an end plate of the positive displacement pump assembly of FIG. 6.
Figure 8:
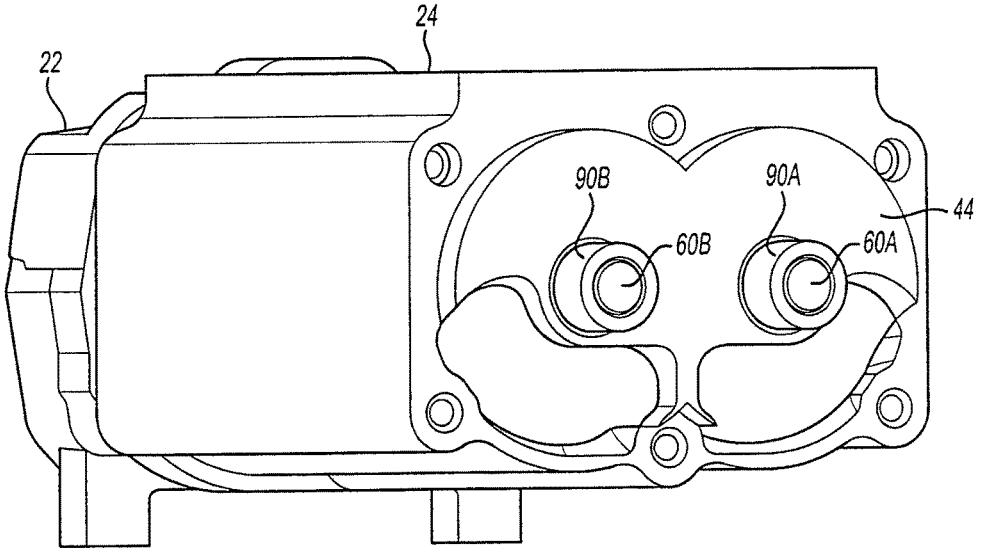
FIG. 8 is a schematic perspective illustration of the positive displacement pump assembly of FIG. 6 with the end portion of the rotor housing removed.

FIGS. 2 and 3 show the unique shape of the outer perimeter 70 of the end plate 44. A first portion 72 of the outer perimeter 70 is shaped to follow the contours of an inner surface 74 of the rotor housing 20. Specifically, the shape of the first portion 72 matches the adjoined cylindrical cavities that form the rotor cavity 38 to house the rotors 12, 14, and also matches a recess 75 in the end portion 26 in which the end plate 44 is housed. The end plate 44 partially closes the open end of the midportion 24 to define the end 58 of the rotor cavity 38. The end plate 44 is sized so that the first portion 72 of the perimeter 70 can slide axially relative to the inner surface of the end portion 26 at the recess 75 but minimizes air leakage around the perimeter 70. The inner surface 74 of an alternative embodiment of the end portion 126 is shown in FIG. 7. The end portion 126 has the same inner surface 74 as the end portion 26.

Figure 4:
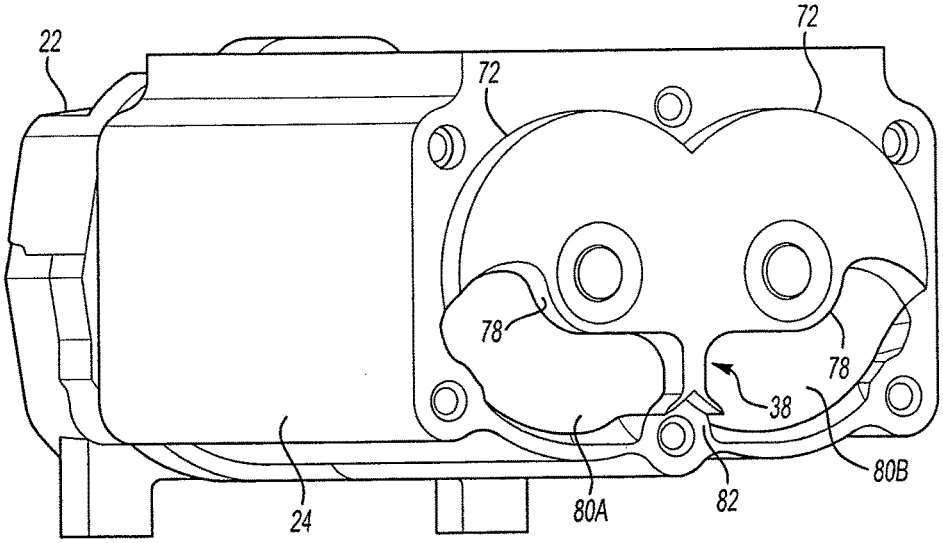
FIG. 4 is a schematic perspective illustration of the positive displacement pump assembly of FIG. 1, with an end portion of the rotor housing removed.

A second portion 78 of the perimeter 70 shown in FIG. 2 partially defines inlets 80A, 80B into the rotor cavity 38, referred to herein as air inlets. The air inlets 80A, 80B are aligned with the air inlet 40 in the end portion 26. The midportion 24 defines the remainder of the air inlets 80A, 80B, as shown in FIG. 4. The inner surface of the midportion 24 forms a support rib 82 that runs axially along the rotor cavity 38 and partially separates the adjoined cylindrical cavities of the rotor cavity 38. The inner surface of the end portion 26 at the air inlet 40 has a support rib 83 that aligns with the support rib 82 when the end portion 26 is fastened to the midportion 24. The end plate 44 has an extension 84 with a flared end 86 that is configured to conform to the shape of the support rib 83. The support rib 83 helps to support the end plate 44 within the end portion 26.

Figure 6:
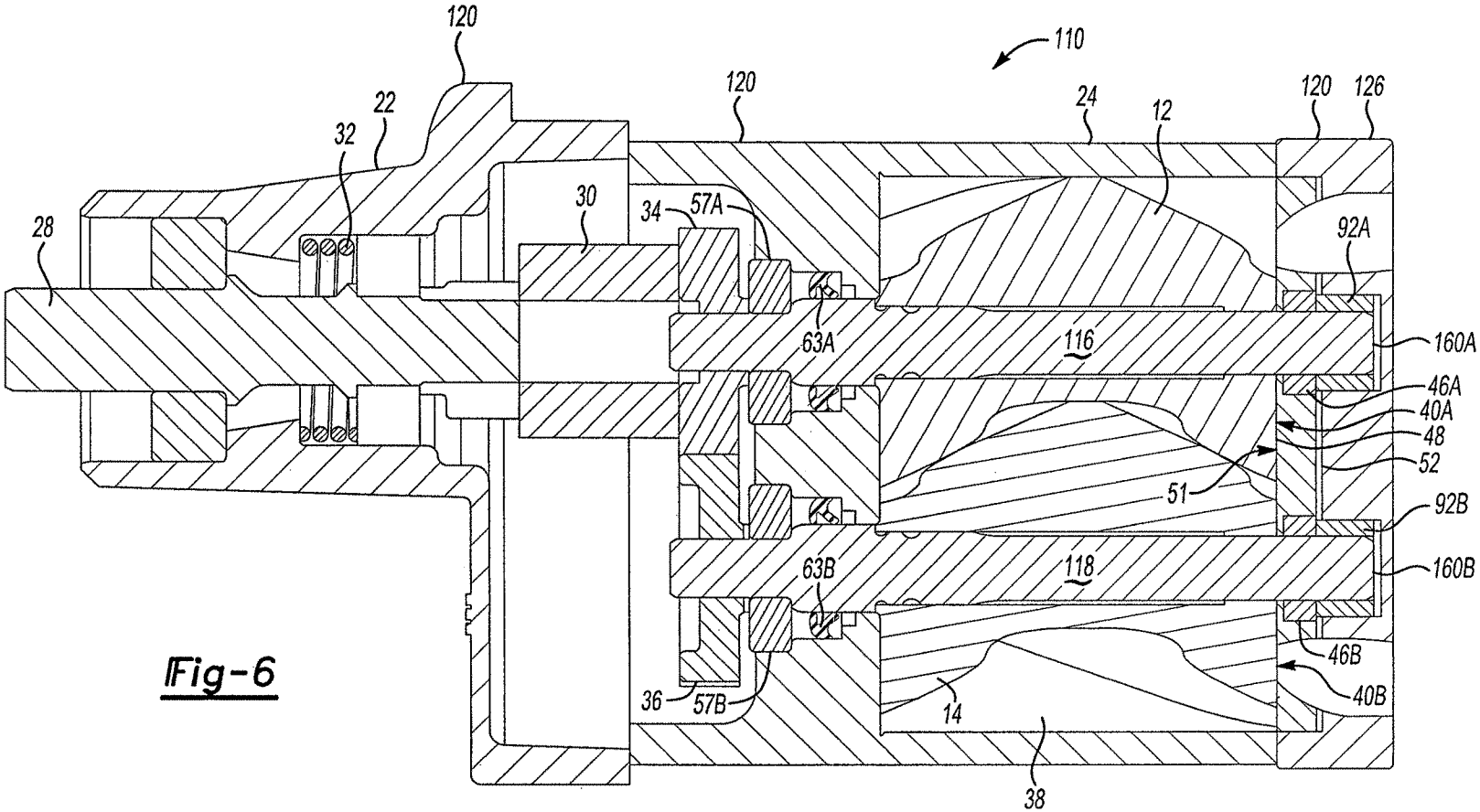
FIG. 6 is a schematic cross-sectional illustration of a positive displacement pump assembly in accordance with another aspect of the present teachings.

FIG. 6 shows a second embodiment of a positive displacement pump assembly 110 that is the same as is described with respect to the positive displacement pump assembly 10 except that rotor shafts 116, 118 and an end portion 126 of the positive displacement pump housing 120 have a different configuration. Specifically, first and second rotor shafts 116, 118 are used that extend into an end portion 126 that has openings 90A, 90B. Ends 160A, 160B of the rotor shafts 116, 118 extend beyond the end plate 44. The positive displacement pump housing 120 includes the front cover 22, the midportion 24 and the end portion 126. Needle bearings 92A, 92B are supported in the openings 90A, 90B and surround the rotor shafts 116, 118. The rotor shafts 112, 118 are axially fixed relative to the front cover 22 and an end portion 126 by both sets of the bearings 57A, 57B and 46A, 46B. The needle bearings 92A, 92B allow the rotor shafts 116, 118 to move axially relative to the end portion 126 and function as an additional positional reference for the rotor shafts 116, 118 with respect to the housing 120. The end portion 126 and the end plate 44 define the clearance 52, and the rotor end faces 40A, 40B and the face 51 of the end plate 44 define the clearance 48 just as in the embodiment of the positive displacement pump assembly 10.

The reference numbers used in the drawings and the specification along with the corresponding components are as follows:

10 positive displacement pump assembly
12 first rotor
14 second rotor
16 first rotor shaft
18 second rotor shaft
20 positive displacement pump housing
22 front cover
24 midportion
26 end portion
28 input shaft
30 coupling
32 torsion spring
34 first timing gear
36 second timing gear
38 rotor cavity
39 inlet
40A, B first axial end faces
42 outlet
43A, B second axial end faces
44 end plate
45 clearance
46A, B first axial bearings
48 first axial clearance
50A, B stepped openings of end plate
51 face of end plate
52 second clearance
54 internal surface of end portion
56 face of end plate
57A, B second pair of axial bearings
58 end of rotor cavity
59A, B stepped openings in end portion
60A, B ends of rotor shafts
63A, B seals
65A, B second axial ends
70 outer perimeter of end plate
72 first portion of outer perimeter
74 inner surface of end plate
75 recess of end plate
78 second portion of outer perimeter
80A, B inlets
82 support rib of midportion
83 support rib of end portion
84 extension
86 flared end
90A, B openings in end portion 126
92A, B needle bearings
110 positive displacement pump assembly
116 first rotor shaft
118 second rotor shaft
120 positive displacement pump housing
126 end portion
160A, B ends of rotor shafts While the best modes for carrying out the many aspects of the present teachings have been described in detail, those familiar with the art to which these teachings relate will recognize various alternative aspects for practicing the present teachings that are within the scope of the appended claims.

The invention claimed is:

1. A positive displacement pump assembly comprising:
a rotor housing defining a rotor cavity;
an end plate configured to at least partially close one end of the rotor cavity;
rotor shafts extending through the rotor cavity;
rotors supported on and fixed to the rotor shafts, the rotors having axial ends with end faces that face the end plate;
a first pair of bearings rotatably mounting and axially fixing the rotor shafts to the end plate such that the position of the end plate with respect to the shafts is fixed to control a clearance between the end plate and the end faces of the rotors; and
a second pair of bearings rotatably mounting the rotor shafts to the rotor housing;
wherein the end plate is axially movable with the rotor shafts relative to the rotor housing when the rotor shafts vary in axial length due to thermal fluctuations to thereby reduce changes in an axial clearance at the end faces; and
wherein the end plate at least partially defines at least one inlet into the rotor cavity.

2. The positive displacement pump assembly of claim 1, further comprising a second axial clearance, wherein the rotor housing has a midportion that defines the rotor cavity and further includes an end portion fixed to the midportion and wherein the second axial clearance is between the end plate and the end portion and varies as the rotor shafts and the end plate move axially.

3. The positive displacement pump assembly of claim 2, wherein the rotor shafts extend through the end plate into the end portion; and further comprising:
needle bearings between the rotor shafts and the end portion.

4. The positive displacement pump assembly of claim 2, wherein the rotor shafts have ends flush with a face of the end plate at the second axial clearance.

5. The positive displacement pump assembly of claim 1, wherein the end plate has stepped openings configured to receive the first pair of bearings and the rotor shafts.

6. The positive displacement pump assembly of claim 1, wherein the end plate has an outer perimeter with a portion shaped to follow contours of an inner surface of the rotor housing.

7. The positive displacement pump assembly of claim 6, wherein another portion of the outer perimeter of the end plate at least partially defines the at least one inlet into the rotor cavity.

8. The positive displacement pump assembly of claim 1, wherein the rotor shaft is a first material and the rotor housing is a second material; and
wherein the first and the second materials have different rates of thermal expansion.

9. The positive displacement pump assembly of claim 1, further comprising timing gears mounted on the rotor shafts, wherein the timing gears are positioned on the rotor shafts opposite the first pair of bearings and positioned outside the rotor cavity.

10. The positive displacement pump assembly of claim 1, wherein the positive displacement pump assembly is configured as a supercharger adapted to pump air.

11. The positive displacement pump assembly of claim 1, wherein leakage of fluid through the axial clearance at the end faces is minimized by minimizing the changes in the axial clearance as the rotors vary in axial length due to the thermal fluctuations.

12. The positive displacement pump assembly of claim 1, wherein the first pair of bearings rotatably mounting and axially fixing the rotor shafts to the end plate is configured so that the end plate moves axially with the rotor shafts relative to the rotor housing.

13. A positive displacement pump assembly comprising:
a rotor housing defining a rotor cavity;
an end plate configured to at least partially close one end of the rotor cavity; rotor shafts
extending through the rotor cavity;
rotors supported on and fixed to the rotor shafts, the rotors having axial ends with end faces that face the end plate;
a first pair of bearings rotatably mounting the rotor shafts to the end plate; and
a second pair of bearings rotatably mounting the rotor shafts to the rotor housing;
wherein the end plate is axially movable with the rotor shafts relative to the rotor housing when the rotor shafts vary in axial length due to thermal fluctuations to thereby reduce changes in an axial clearance at the end faces;
wherein the end plate at least partially defines at least one inlet into the rotor cavity;
wherein the end plate has an outer perimeter with a portion shaped to follow contours of an inner surface of the rotor housing;
wherein another portion of the outer perimeter of the end plate at least partially defines the at least one inlet into the rotor cavity; and
wherein the at least one inlet includes a pair of inlets and wherein the end plate has an extension configured to rest on the inner surface of the rotor housing to separate the pair of inlets.

14. A positive displacement pump assembly comprising:
a rotor housing having a midportion that defines a rotor cavity that extends through the midportion;
a rotor shaft defining an axis and extending through the rotor cavity;
a rotor supported by and fixed to the rotor shaft for rotation about the axis, the rotor having an axial end face;
an end plate within the rotor housing at least partially defining a fluid passage into an end of the rotor cavity; and
a bearing on the rotor shaft between the end plate and the rotor shaft and configured so that the end plate is axially fixed by the bearing relative to the rotor shaft such that the position of the end plate with respect to the shaft is fixed to control a clearance between the end plate and the axial end face of the rotor, wherein the end plate moves axially with the rotor shaft relative to the rotor housing due to thermal fluctuations.

15. The positive displacement pump assembly of claim 14, further comprising:
a second axial clearance;
wherein the rotor housing further includes an end portion fixed to the midportion of the rotor housing; and
wherein the second axial clearance is between the end plate and the end portion and varies as the rotor shaft and the end plate move axially.

16. The positive displacement pump assembly of claim 15, wherein the rotor shaft extends through the end plate into the end portion; and further comprising:
a needle bearing between the rotor shaft and the end portion.

17. The positive displacement pump assembly of claim 15, wherein the rotor shaft has an end flush with a face of the end plate at the second axial clearance.

18. The positive displacement pump assembly of claim 14, wherein the end plate has a stepped opening configured to receive the bearing and the rotor shaft.

19. The positive displacement pump assembly of claim 14, wherein the end plate has an outer perimeter with a portion shaped to follow contours of an inner surface of the rotor housing.

20. The positive displacement pump assembly of claim 19, wherein another portion of the outer perimeter of the end plate at least partially defines the fluid passage into the end of the rotor cavity.

21. The positive displacement pump assembly of claim 14, wherein the bearing is a first bearing and the axial end face of the rotor is a first end face; and further comprising:
a second bearing between the rotor housing and the rotor shaft at an opposite end of the rotor than the first bearing so that the rotor shaft is axially fixed relative to the rotor housing at the second bearing.

22. The positive displacement pump assembly of claim 14, wherein the rotor shaft is a first material and the rotor housing is a second material; and
wherein the first and the second materials have different rates of thermal expansion.

23. The positive displacement pump assembly of claim 14, further comprising:
a second rotor shaft defining a second axis and extending through the rotor cavity; a second rotor supported by and fixed to the second rotor shaft for rotation about the second axis, the second rotor having a second axial end face; and
a second bearing on the second rotor shaft between the end plate and the second rotor shaft and configured so that the end plate is axially fixed by the second bearing relative to the second rotor shaft and thereby moves axially with the second rotor shaft relative to the rotor housing due to the thermal fluctuations to thereby reduce changes in a second axial clearance at the second axial end face of the second rotor.

24. A positive displacement pump assembly comprising:
a rotor housing having a midportion that defines a rotor cavity that extends through the midportion;
a rotor shaft defining an axis and extending through the rotor cavity;
a rotor supported by and fixed to the rotor shaft for rotation about the axis, the rotor having an axial end face;
an end plate within the rotor housing at least partially defining a fluid passage into an end of the rotor cavity; and
a bearing on the rotor shaft between the end plate and the rotor shaft and configured so that the end plate is axially fixed relative to the rotor shaft and moves axially with the rotor shaft relative to the rotor housing due to thermal fluctuations to thereby reduce changes in an axial clearance at the axial end face of the rotor;
wherein the end plate has an outer perimeter with a portion shaped to follow contours of an inner surface of the rotor housing;

wherein another portion of the outer perimeter of the end plate at least partially defines the fluid passage into the end of the rotor cavity; and wherein the end plate has an extension configured to rest on the inner surface of the rotor housing to separate the fluid passage into a pair of fluid passages.

25. A positive displacement pump assembly comprising:

a rotor housing that defines a rotor cavity having a first end;

a first and a second rotor shaft extending through the rotor cavity;

a first and a second rotor configured to rotate within the rotor cavity on the first and second rotor shafts, respectively, each of the rotors having a first end face and a second end face at opposite first and second axial ends;

an end plate positioned to at least partially close the first end of the rotor cavity;

a first pair of bearings on the rotor shafts between the end plate and the rotor shafts and configured so that the end plate is axially fixed by the bearings relative to the rotor shafts such that the position of the end plate with respect to the first and second rotor shafts is fixed to control a clearance between the end plate and the rotor first and second end faces, wherein the end plate moves axially with the rotor shafts relative to the rotor housing;

a second pair of bearings on the rotor shafts between the rotor housing and the rotor shafts and configured to prevent the first and second rotors from moving axially relative to the rotor housing; and a first and a second timing gear mounted on the first and second rotor shafts, respectively, the timing gears adapted to coordinate rotational movement of the first and second rotors, and the timing gears positioned outside of the rotor cavity.

26. The positive displacement pump assembly of claim 25, wherein the timing gears are positioned adjacent the second pair of bearings.

* * * * *